United States Patent [19]

Branker

[11] Patent Number: 4,528,706

[45] Date of Patent: Jul. 16, 1985

[54] MULTI-POSITION SECTIONAL MATTRESS

[76] Inventor: H. Earle Branker, 1220 Blair Mill Rd., Silver Spring, Md. 20910

[21] Appl. No.: 445,707

[22] Filed: Dec. 1, 1982

[51] Int. Cl.[3] ..... A61G 7/04; A47C 27/14

[52] U.S. Cl. ..... 5/465; 5/481; 5/446; 5/431

[58] Field of Search ..... 5/12 R, 431–434, 5/436, 437, 446, 465, 481

[56] References Cited

U.S. PATENT DOCUMENTS

| | | | |
|---|---|---|---|
| 149,758 | 4/1878 | Junge . | |
| 817,139 | 4/1906 | Coopersmith . | |
| 988,117 | 3/1911 | Leonard . | |
| 1,927,109 | 9/1933 | Abrams | 5/465 |
| 2,051,703 | 8/1936 | Hall | 5/465 |
| 2,395,699 | 2/1946 | Waldo | 5/465 |
| 2,702,909 | 3/1955 | Atkins | 5/465 |
| 3,243,828 | 4/1966 | McCarty | 5/437 |
| 3,333,286 | 8/1967 | Biolik | 5/431 |
| 3,672,720 | 6/1972 | Wilson | 5/65 |
| 4,074,374 | 2/1978 | Ayesh . | |
| 4,256,096 | 3/1981 | Buddle | 5/465 |

FOREIGN PATENT DOCUMENTS

| | | | |
|---|---|---|---|
| 546541 | 4/1956 | Belgium | 5/465 |
| 1779537 | 9/1975 | Fed. Rep. of Germany | 5/481 |
| 2842428 | 5/1979 | Fed. Rep. of Germany | 5/465 |
| 58180 | 10/1911 | Switzerland | 5/465 |

*Primary Examiner*—Gary L. Smith
*Assistant Examiner*—Michael F. Trettel
*Attorney, Agent, or Firm*—Roylance, Abrams, Berdo & Goodman

[57] ABSTRACT

A mattress comprises a body portion and a head portion longitudinally spaced from the body portion. The head portion is longitudinally bifurcated to provide relatively movable, upper and lower sections. The upper section is hingedly coupled to the body portion along a hinge axis substantially coplanar with the planar top surface of the body portion. The upper portion can be rotated through an angle of approximately 180° about the hinge axis from a first portion overlying the lower section to a second position overlying the body portion top surface. Additionally, the upper section may be located in any desired angle between the first and second positions. In this manner, the mattress has a wide variety of functions.

13 Claims, 7 Drawing Figures

MULTI-POSITION SECTIONAL MATTRESS

BACKGROUND OF THE INVENTION

1. Field of the Invention

This invention relates to a mattress having a plurality of sections which can be arranged in multiple positions. More particularly, the present invention relates to a mattress having a head portion longitudinally bifurcated to provide upper and lower sections, and a body portion to which the upper section is hinged such that the upper section can be rotated through an angle of approximately 180° about its hinge axis to arrange the mattress in a plurality of positions.

2. Description of the Prior Art

A conventional mattress usually comprises a single section which cannot be readily arranged in a plurality of positions. Even if the mattress can be folded from a lying position or to a sitting position the mattress cannot be readily folded to provide a plurality of levels.

Conventional sectional mattresses can have a plurality of hinge sections. However, such sections are typically arranged to permit storage (e.g., U.S. Pat. No. 149,758 to Jung) or to permit the mattress or pad to be used as a sofa or a bed (e.g., U.S. Pat. No. 817,139 to Coopersmith). However, such mattresses or pads cannot be readily employed on a standard bed to provide a plurality of arrangements including a conventional reclining surface, multiple sitting positions and a multi-level arrangement for coital activity.

U.S. Pat. No. 988,177 to Leonard discloses a casket mattress having a body portion longitudinally bifurcated at its head end to provide a basal layer and an overlying layer. The overlying layer extends beyond the basal layer to permit it to be rolled up and provide a head rest. Although the overlying layer is pivotable relative to the remainder of the mattress, the pivot axis is located within the material of the overlying layer such that the overlying layer cannot lie flat against the other end portion of the mattress.

SUMMARY OF THE INVENTION

Accordingly, it is an object of the present invention to provide a mattress having a plurality of sections which can be easily arranged in a reclining position, a sitting position and a multi-level position.

Another object of the present invention is to provide a mattress of rugged construction which is inexpensive and simple to manufacture and operate.

A further object of the present invention is to provide a mattress which can be arranged with multiple surfaces deployed to support a male and female in a wide variety of coital positions, and especially with the female on the upper surface and the male kneeling on the lower surface.

The foregoing objects are attained by providing a mattress comprising a body portion and a head portion longitudinally spaced from the body portion. The body portion has a generally planar top surface. The head portion is longitudinally bifurcated to provide relatively movable, upper and lower sections. The upper section is pivotally coupled to the body portion by a hinge having a hinge axis substantially coplanar with the body portion top surface.

By forming the mattress of the present invention in this manner, the upper section can be easily rotated approximately 180° about its hinge axis from a first position overlying the lower section to a second position overlying the body portion top surface. In the first position, the mattress forms a normal, planar bed surface with the upper surface of the upper section and the top surface of the body portion. In the second position, surfaces at three different levels are provided with the lowest level provided by the lower section, the highest level provided by the upper section flatly overlying the body portion and an intermediate level provided by an exposed area of the body portion. This variety of levels facilitates a number of functional and comfortable coital positions. Additionally, the upper section may be located in any one of the angular positions between the first and second positions to provide a number of sitting orientations.

The upper and lower sections and the body portion can be separated by horizontal and vertical slits with the vertical slit closed by an upper portion of the hinge. The body portion and the lower section of the head end portion can be formed as a single, unitary member. The hinge can comprise a flexible strip joined at its opposite sides to the body and upper section. In order to maintain the upper section in an angular or sitting position, a suitable support means can be provided between the upper and lower sections.

Preferably, the upper surface of the upper section is planar and is coplanar with the top surface of the body portion. This permits the upper section to lie flat against and be parallel to the body portion in the second position and to provide a planar bed surface in the first position.

The upper section can be tapered in thickness in a direction away from its hinge and provided with a depending shoulder remote from the hinge. When the upper section is configured in this manner and is located in the second position, the upper section provides a tilted surface permitting a more advantageous coital position with a shoulder stop preventing the female from slipping from the desired position.

Other objects, advantages and salient features of the present invention will become apparent from the following detailed description which, taken in conjunction with the annexed drawings, discloses preferred embodiments of the present invention.

BRIEF DESCRIPTION OF THE DRAWINGS

Referring to the drawings which form a part of this original disclosure.

DETAILED DESCRIPTION OF THE PREFERRED EMBODIMENTS OF THE INVENTION

Figure 1:
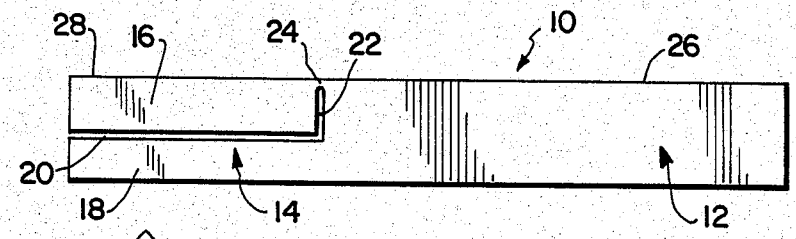
FIG. 1 is a side elevational view illustrating a mattress in accordance with a first embodiment of the present invention arranged in a reclining position.

Referring initially to the embodiment of the invention illustrated in FIGS. 1–4, mattress 10 comprises a body portion 12 and a head portion 14 longitudinally spaced from the body portion. In the reclining position illustrated in FIG. 1, the head and body portions have an outer configuration of a conventional mattress. Any suitable material can be employed to form the mattress including foam rubber, fabric and plastic.

Head portion 14 is longitudinally bifurcated to form an upper section 16 and a lower section 18. The upper and lower sections are separated by a horizontal slit 20, while the upper section and body portion 12 are separated by a vertical slit 22. The two slits are joined to provide an L-shaped separation defining the upper section 16. The upper section has a length less than one-half the overall length of the mattress.

Upper section 16 is pivotally coupled to body portion 12 by a hinge 24 which permits the upper section to pivot relative to the body portion about a hinge axis substantially coplanar with the planar top surface 26 of body portion 12. Hinge 24 can comprise a unitary portion of the upper section and body portion or can comprise a reinforced strip of material suitable affixed to the upper section 16 and body portion 12 along the opposite sides of the flexible strip. Lower section 16 is formed as a unitary, one-piece member with the body portion 12.

Figure 2:
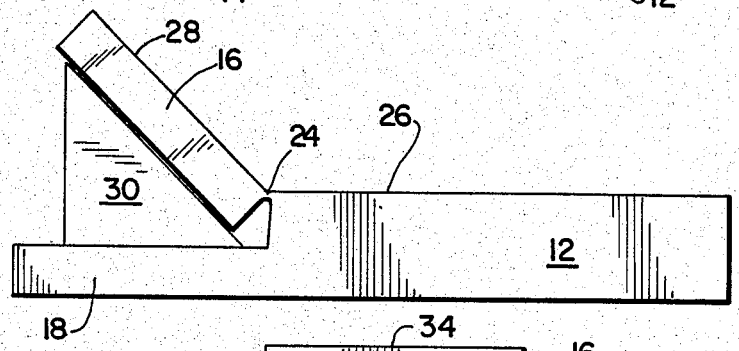
FIG. 2 is a side elevational view illustrating the mattress of FIG. 1 arranged in a sitting position.
Figure 3:
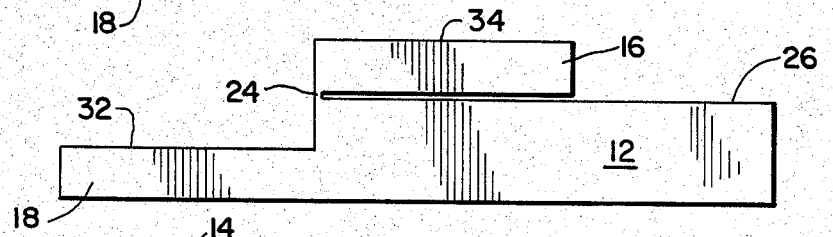
FIG. 3 is a side elevational view illustrating the mattress of FIG. 1 arranged in a coital position.
Figure 4:
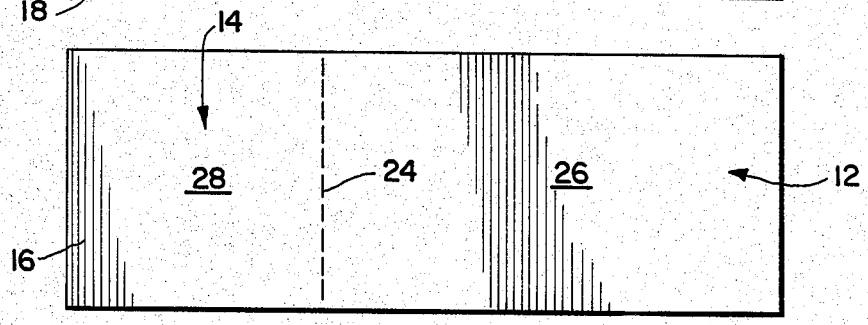
FIG. 4 is a top plan view of the mattress of FIG. 1 arranged in a reclining position.

As illustrated in FIGS. 1–3, mattress 10 can be arranged in a variety of positions. In the reclining position of FIG. 1, planar top surface 26 of body portion 12 is coplanar with the planar upper surface 28 of upper section 16 when upper section 16 overlies lower section 18.

The sitting position of mattress 10 is illustrated in FIG. 2. In this arrangement, surfaces 26, 28 are oriented at an obtuse angle permitting a person to maintain a sitting position on the bed. A suitable support 30 can be positioned between sections 16, 18 to maintain upper section 16 at the desired angle relative to body portion 12. The support can comprise a cushion or a support framework which can be coupled to the bed frame and adjusted to various angular positions.

In the coital position illustrated in FIG. 3, upper section 16 overlies and is supported horizontally on top surface 26. When upper section 16 is pivoted to overlie the top surface of body portion 12, a portion of top surface 26 remains exposed due to the relative dimensions thereof. In this position, the exposed surface 32 of lower section 18, the exposed surface 34 of upper section 16 and the exposed portion of top surface 26 provide three different levels which can be comfortably employed in a variety of coital positions. Since the hinge axis of hinge 24 is located in the same plane as surfaces 26, 28, upper section 16 will lie flat in a stable manner on top surface 26. In the embodiment of FIG. 1, surface 34 is planar.

Thus, by forming mattress 10 in this manner, its upper section can be rotated approximately 180° about its hinge axis from a first position (illustrated in FIGS. 1 and 4) overlying lower section 18 to a second position (illustrated in FIG. 3) overlying the body portion top surface, and any desired angular position therebetween (illustrated in FIG. 2).

Figure 5:
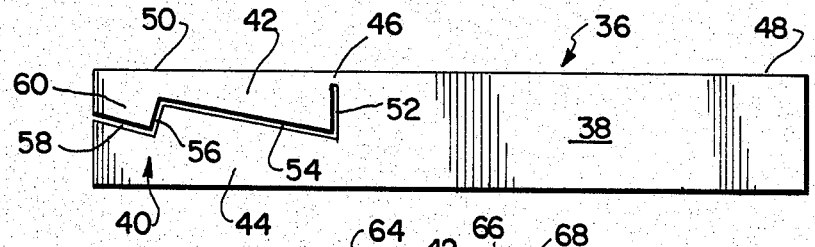
FIG. 5 is a side elevational view of a mattress in accordance with a second embodiment of the present invention arranged in a reclining position.
Figure 6:
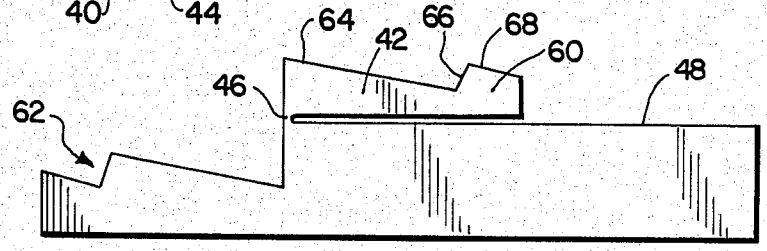
FIG. 6 is a side elevational view of the mattress of FIG. 5 arranged in a coital position.

FIGS. 5 and 6 disclose a mattress 36 according to a second embodiment of the present invention. Mattress 36 comprises a body portion 38, and a head portion 40. Head portion 40 is bifurcated to provide an upper section 42 and a lower section 44. As in the first embodiment, upper section 42 is pivotally coupled to body section 38 about a hinge 46 providing a hinge axis coplanar with the planar top surface 48 of body portion 38 and the planar upper surface 50 of upper section 42. Hinge 46 may be formed identically to hinge 24 of mattress 10.

Upper section 42 is separated from body portion 38 by a vertical slit 52 closed on its upper end by hinge 46. However, the upper and lower sections are separated by angular slits 54, 56, 58. Slit 54 defines a portion of upper section 42 which tapers in thickness away from hinge means 46. Slits 56, 58 define a shoulder or head rest 60 at the end of upper section 42 remote from hinge 46. Additionally, slits 56, 58 form a recess in the upper surface of lower section 16.

In the reclining position illustrated in FIG. 5, upper section 42 overlies lower section 44 to provide a planar surface across the entire length of mattress 36 defined by surfaces 50 and 48. Shoulder 60 is received within recess 62 to provide proper nesting of the upper and lower sections. When upper section 42 is pivoted 180° about hinge 46 such that surface 50 overlies and contacts top surface 48 the exposed surface 64 of upper section 42 is located at an angle extending downwardly towards surface 48. The angular orientation of surface 64 has been found to facilitate numerous coital positions.

Shoulder 60 presents a generally vertical surface 66 which functions as a shoulder rest to prevent a person lying on surface 64 from sliding downwardly. Surface 66 faces in the general direction of the lower section to provide this stop function. Additionally, shoulder 60 has a top surface 68 which can function effectively as a head rest for comfortably supporting the head of the person (usually the female) lying on surface 64.

Figure 7:
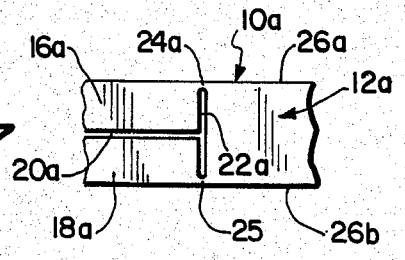
FIG. 7 is a partial, side elevational view of a mattress in accordance with a third embodiment of the present invention arranged in a reclining position.

FIG. 7 discloses a mattress **10*a* according to a third embodiment of the present invention. Mattress 10*a* comprises a body portion 12*a* and a head portion 14*a* bifurcated to define an upper section 16*a* and a lower section 18*a*. The upper and lower sections and the body portion are divided by a T-shaped separation comprising a horizontal slit 20*a* and a vertical slit 22*a*. Slit 22*a* terminates in two hinges 24*a* and 25 which are coplanar with body portion surfaces 26*a*, 26*b*** to permit the mattress to be inverted without negating its functionality.

The mattresses of both embodiments provide a wide variety of functions particularly useful to handicapped individuals. The mattresses permit the individuals to recline or to rest in a sitting position. Additionally, the couch can be oriented to provide a number of suitably arranged surfaces at different levels facilitating a wide variety of coital positions which would otherwise be difficult or impossible to obtain.

While particular embodiments have been chosen to illustrate the invention, it will be understood by those skilled in this art that various changes and modifications can be made therein without departing from the scope of the invention as defined in the appended claims.

What is claimed is:

1. A mattress, comprising:

a body portion having a generally planar top surface;

a head portion longitudinally spaced from said body portion, said head portion being longitudinally bifurcated to provide relatively movable, upper and lower sections; and hinge means pivotally coupling said upper section to said body portion along a hinge axis substantially coplanar with said top surface;

said upper section including a lower surface having a shoulder extending therefrom, said shoulder being adjacent an end of said upper section remote from said hinge means;

said upper section being rotatable through approximately 180° about said hinge axis from a first position overlying said lower section to a second position overlying said body portion top surface;

said upper section having a planar upper surface coplanar with said top surface of said body portion in said first position, and tapering in thickness away from said hinge means to expose a surface of said upper section in said second position extending downwardly and away from said hinge means.

2. A mattress according to claim 1 wherein said upper and lower sections are separated by a generally horizontal slit.

3. A mattress according to claim 2 wherein said upper section and said body portion are separated by a vertical slit closed at an upper end thereof by said hinge means.

4. A mattress according to claim 3 wherein said horizontal and vertical slits are joined.

5. A mattress according to claim 4 wherein said body portion and said lower section are unitarily formed as a single member.

6. A mattress according to claim 1 wherein said body portion and said lower section are unitarily formed as a single member.

7. A mattress according to claim 1 wherein said hinge means comprises a flexible strip joined at opposite side edges thereof to said body portion and said upper section.

8. A mattress according to claim 1 further comprises support means for maintaining said upper section in at least one angular position between said first and second positions.

9. A mattress according to claim 1 wherein said upper and lower sections are separated by a slit extending at an acute angle relative to said top surface.

10. A mattress according to claim 1 wherein said shoulder is defined by a generally vertical surface facing in a direction toward said lower section in said second position.

11. A mattress according to claim 10 wherein said lower section has a recess receiving said shoulder in said first position.

12. A mattress, comprising:

a first portion having a generally horizontal first top surface;

a second portion coupled to and extending from said first portion, and having a second top surface spaced vertically from said first top surface; and a third portion mounted on said first top surface and tapering away from said second portion to provide a third top surface spaced from said second top surface and slanting downwardly in a direction away from said second portion, said third portion including a shoulder extending from said third top surface, said shoulder being adjacent an end of said third portion remote from said second portion.

13. A mattress according to claim 12 wherein said shoulder is defined by a generally vertical surface facing in a direction toward said second portion.

* * * * *